United States Patent [19]

Nepomiastchy et al.

[11] 4,447,990

[45] May 15, 1984

[54] MACHINE FOR FINISHING FERRITE MAGNETIC POT CORES

[75] Inventors: Alexis Nepomiastchy, Paris; Guy R. F. Pireyre, Montlucon, both of France

[73] Assignee: Societe Anonyme de Telecommunications, Paris, France

[21] Appl. No.: 294,297

[22] Filed: Aug. 19, 1981

[30] Foreign Application Priority Data

Aug. 22, 1980 [FR] France ..... 80 18357

[51] Int. Cl.[3] ..... B24B 7/00

[52] U.S. Cl. ..... 51/76 R; 51/215 E

[58] Field of Search ..... 51/61, 76 R, 138, 215 E

[56] References Cited

U.S. PATENT DOCUMENTS

| | | | |
|---|---|---|---|
| 518,594 | 5/1894 | Hubbard | 51/76 R |
| 1,305,731 | 6/1919 | Maier | 51/76 R |
| 1,976,112 | 10/1934 | Binns . | |
| 2,145,961 | 2/1939 | Whitehouse | 51/76 R |
| 2,408,334 | 9/1946 | Oliver . | |
| 2,796,707 | 6/1957 | Meter | 51/215 E |
| 3,169,446 | 2/1965 | Anderson et al. | 51/215 E |
| 3,499,249 | 3/1970 | Aberle | 51/138 |
| 3,636,663 | 1/1972 | Menzel | 51/138 |

FOREIGN PATENT DOCUMENTS

| | | |
|---|---|---|
| 2184386 | 12/1973 | France . |
| 2293047 | 6/1976 | France . |

*Primary Examiner*—Harold D. Whitehead
*Assistant Examiner*—K. B. Adolphson
*Attorney, Agent, or Firm*—Owen, Wickersham & Erickson

[57] ABSTRACT

Machine for finishing magnetic half-pots which have, on the open side, side edges for assembling half-pots together and a center part designed to be machined to create a preset air gap for the pot core assembly, by use of a grinding wheel projecting through a reference plane supporting the side edges of the half-pots. The half-pots are fed in front of the wheel and pressed onto the reference plane by a flexible support wheel engaging directly with the bottom of each half-pot to form a back support for grinding.

6 Claims, 9 Drawing Figures

MACHINE FOR FINISHING FERRITE MAGNETIC POT CORES

BACKGROUND OF THE INVENTION

The invention relates to the finishing of magnetic pot or cup cores made of ferrite which are used to make up inductors used in big series in telecommunications equipment.

Such inductors are formed by at least one winding which is placed inside a magnetic pot consisting of half-pots assembled joining their open side and having a center portion designed to be machined to create a given air gap for the pot assembly which depends on the required inductance value.

Depending on the applications this value may also be adjusted by providing the centre section of the half-pot with an annular shape receiving a screw-in magnetic slug core designed to enter the gap to a greater or lesser extent.

It has already been proposed in French Pat. No. 2 293 047 by this applicant, for pots of the side opening type, to machine the air gap by tangential attack by the grinding wheel, and notably by applying a machine comprising an endless belt for housing and carrying the half-pots, subjected to pressure means pressing the side edges of the latter onto a reference plane with respect to which the grinding wheel projects through a suitable opening.

However this kind of machine is unsuited to the execution of various small or medium runs (several thousands) corresponding to various pot shapes and dimensions, since the time for changing the set-up, particularly the belt, then turns out to be relatively substantial, as do the adjustments required for the desired machining accuracies, which lead, in particular, to sacrificing a certain number of parts. Similarly, machining is performed with no immediate visual check and any ferrite breakage incident may affect the finish of a certain series of parts before this can be noticed or remedied.

SUMMARY OF THE INVENTION

The object of this invention is to provide an improved machine for finishing magnetic pots made of ferrite by tangential grinding, more especially designed in order to make it relatively simple to change over easily from executing one series of magnetic pots to another in the normal or standard dimensions demanded, and to permit speedy adjustment on a few pots along with visual monitoring of any machining incident so that its consequences can be minimized.

Basically, for this purpose, the machine according to the invention for finishing magnetic half-pots which have, on the open side, two side edges for assembling half-pots together and a center part designed to be machined, to create a given air gap for the pot assembly, by means of a grinding wheel projecting through a reference plane supporting the side edges of the half-pots, with the latter being subjected to drive means and means of travel in front of the grinding wheel and means of pressing against this reference plane. The invention is characterized by having the pressing means comprise a flexible support wheel engaging directly with the bottom of each half-pot to form the grinding back support.

In a preferred form, the drive means comprises elements with openings in them suited to the shape of the half-pots and of lamellar shape in order to move freely between the support wheel and the grinding wheel; these elements are mounted on the extended shafts of an endless drive chain extending parallel to the direction of travel and to the reference plane, so that when pot series are changed these elements are easily interchanged. In addition they lend themselves to a simple feed by a stacking chute under which they travel.

Such a machine can also be advantageously made in light construction, by forming the reference plane by means of a table subjected to prestressing means at a stress which exceeds the half-pot support force exerted by the support wheel.

Furthermore, one embodiment of a machine for finishing magnetic half-pots according to the invention is described below, as an example, with reference being made to the appended drawing.

DESCRIPTION OF A PREFERRED EMBODIMENT

FIGS. 1 to 4 are simply given to illustrate two types of magnetic half-pot for the finishing of which the machine according to the invention finds application without any limitation being implied.

Figure 1:
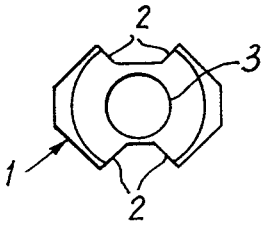
FIGS. 1 and 2 are two illustrative front views, from the open side, of two types of magnetic pot core intended to be machined.
Figure 3:
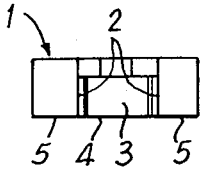
FIGS. 3 and 4 are elevation views, with the open side facing down, of the two types of pot core in FIGS. 1 and 2.

The half-pot 1 in FIGS. 1 and 3 has two side openings 2 providing an open side and a central cylindrical part 3 the end face 4 or bottom of which is flush with the plane of the side edges 5 of the half-pot.

Figure 2:
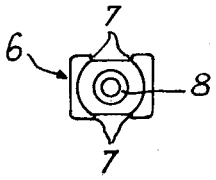
Figure 4:
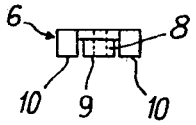

The half-pot 6 in FIGS. 2 and 4 has two side openings 7 providing an open side and a center part with an annular cross-section 8 designed to take a screw-in magnetic core; the end face 9 or bottom of this central part is flush with the plane of the half-pot's side edges 10.

Two half-pots of this type are designed to be assembled together along their side edges after at least one coil has been placed round their center part. An inductor formed like this can take on a range of values depending on the air gap that the machine according to the invention is intended to make between the center parts of the half-pots, i.e. by machining one or both of the above-mentioned end faces for each pot core, which must generally be carried out with an accuracy of around a micron or a fraction of a micron. It can be imagined that this machining may be performed by grinding with a tangent wheel along the axis of the side openings, and preferably in two successive stages, one roughing and the other the actual finishing proper.

The machine designed for this purpose and shown in FIGS. 5 to 9 comprises a bed plate 11 (see FIGS. 6–8) onto which is fastened a base plate 12 (FIGS. 5–8) onto which are installed (FIGS. 5 and 6), by means of two flanged sockets 13, two pillars 14 carrying a support 15 onto which is fixed the machine's work table 16, here made up of two platens 17*a*, 17*b* separated by a middle platen 17*c*, the upper surfaces of which provide a reference plane. The support 15 is supported to be adjustable for height on each pillar by means of a sleeve 18 (FIG. 6), with a bottom flange working in conjunction with a nut 19 that can be screwed up or down on a corresponding threaded section of the pillar and can be locked by a locknut 20.

The platen 17*a* corresponds to the rough grinding station the grinding wheel 21 of which passes through the support 15 in an opening 22 and through the platen in an opening 23 to project above the table plane or reference plane to an adjustable extent.

Platen 17*b* corresponds to the finish grinding station the grinding wheel 24 of which passes through the support 15 in an opening 25 and through the platen in an opening 26 to project above the table plane or reference plane to an adjustable extent.

Each grinding wheel is mounted between a stepped spindle 27 (FIG. 7) and a clamping washer 28 gripped by a safety nut 29 which can be screwed onto the spindle 27. The spindle 27 is fixed to a shaft 30 the body 31 of which is held by means of a clamp 32 in a half-housing 33 (FIG. 8) made for it in a pedestal block 34 which is mounted to be adjustable in height to set the height position of the grinding wheel for the required machining.

Figure 8:
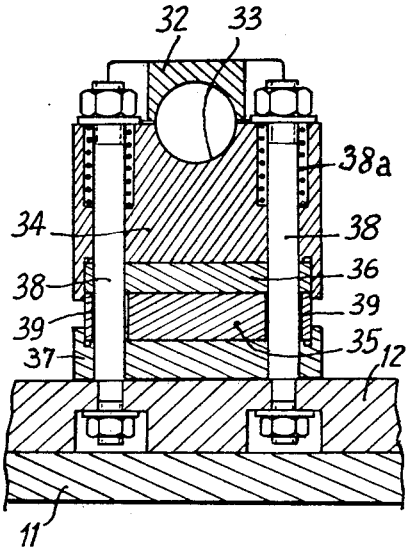
FIG. 8 is a section view along VIII—VIII of FIG. 5.

As shown in FIG. 8, this height adjustable assembly is made up by means of a wedge adjuster (35) inserted beneath the pedestal block 34 between an intermediate pad 36 and a guide 37 having a wedge shape that is complementary to the wedge adjuster 35 and resting on the base plate 12. The whole assembly is held fixed to the base plate 12 by means of springs 38*a* held under pressure by side bolts 38 the shanks of which pass through the block 34, the pad 36 and the guide 37 in corresponding holes, whilst they pass through wedge adjuster 35 in slots 39 which provide for it to be moved for adjustment.

Figure 7:
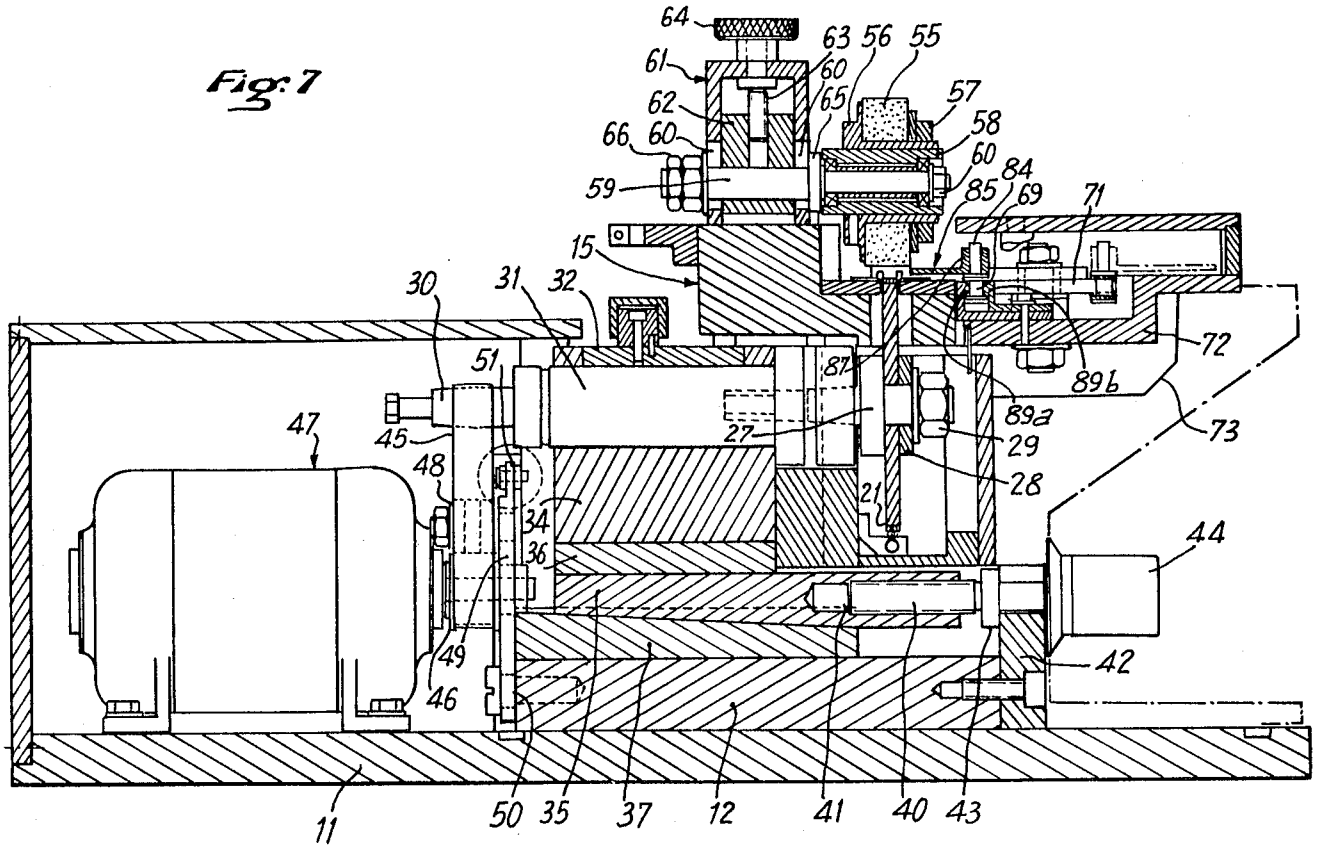
FIG. 7 is a section view along VII—VII of FIG. 6, at the position of one of the machine's machining stations.

As shown in FIG. 7, the latter adjustment movement is provided by means of an adjusting screw 40 engaging with a tapped hole 41 in the wedge adjuster and mounted to rotate in a housing in a front plate 42 fastened to the front edge of the base plate 12, with the screw being held axially with respect to the front plate 42 between a step 43 on it and a rotatable operating knob 44.

Figure 5:
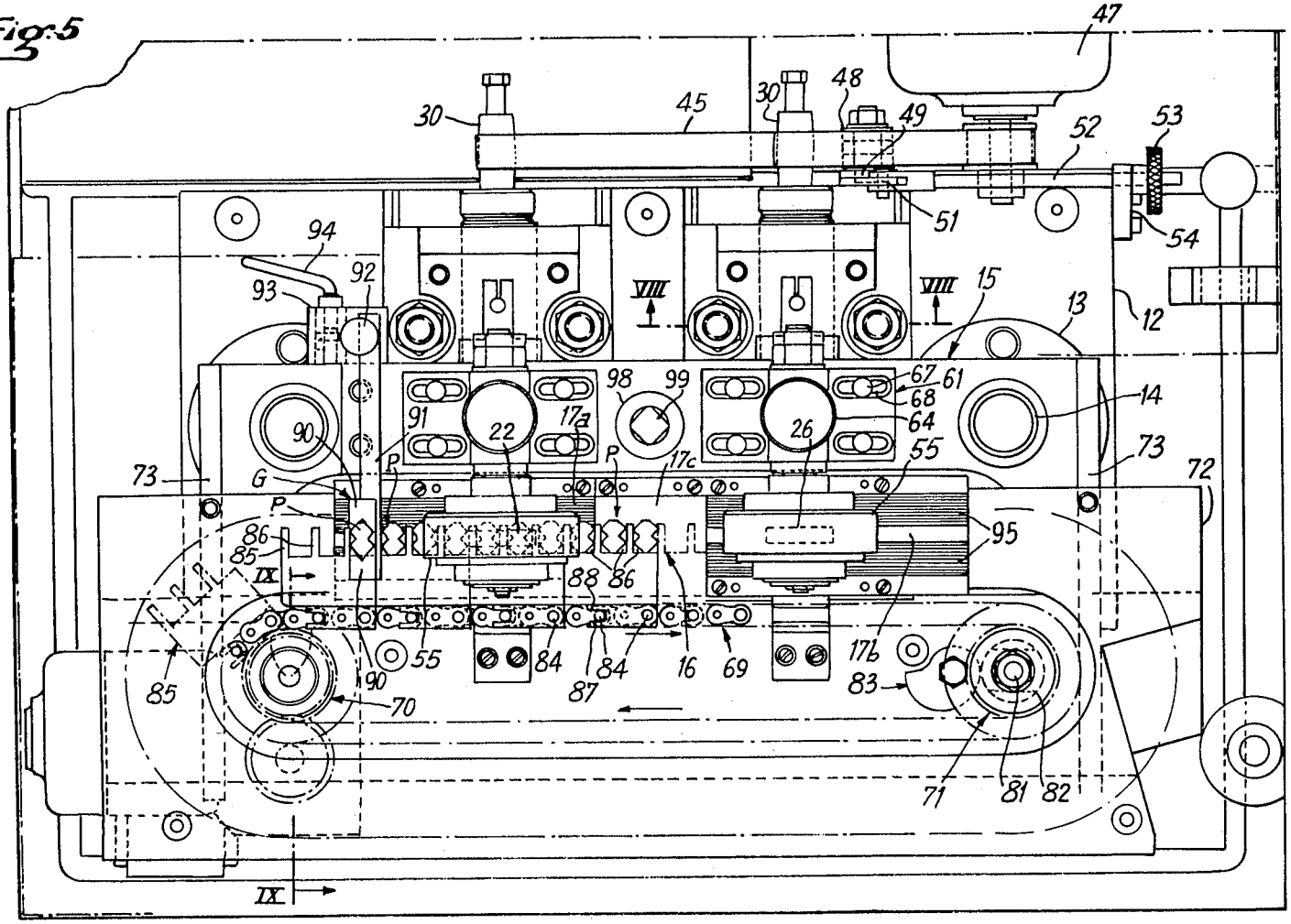
FIG. 5 is a part top view of a machine according to the invention.
Figure 6:
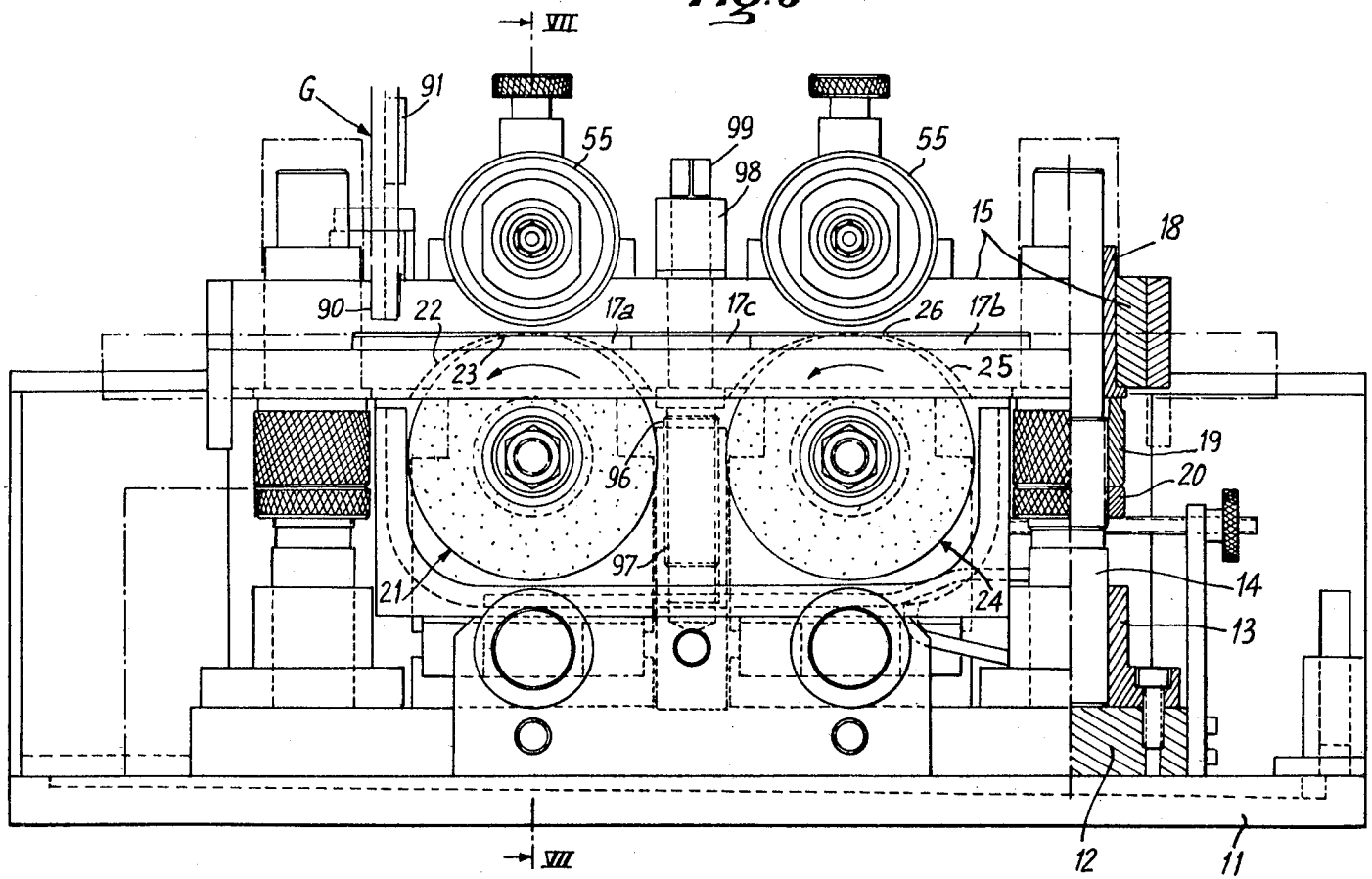
FIG. 6 is a front elevation view of this machine.

As shown in FIGS. 5 and 7, the shafts 30 of the two grinding wheels are driven by means of a shared belt 45 engaged on a drive pulley 46 keyed onto the output shaft of an electric motor 47 and on the pulley 48 of a tensioning system comprising a pulley 48 support arm 49 mounted to swivel at 50 on the rear edge of the base plate 12 and connected at the joint at 51 into the end clevis of an adjustment rod 52 the free threaded end of which engages with a knurled adjustment screw 53 pressing on a plate 54 attached to the base plate 12.

Opposite each grinding wheel and above the corresponding platen an elastomer, for example polyurethane, pressure or support wheel 55 (FIG. 7) is mounted to be adjustable in height with respect to the support 15 of the platens. This flexible support wheel 55 provides the support force by self-deformation and is removably mounted on a stepped support 56 and gripped, beneath a washer, by means of a nut 57 that can be screwed on the support. Support 56 is fixed to a sleeve 58 mounted by rolling bearings on a stepped shaft 59 on which it is held by an end nut 60. This shaft 59 is mounted to be movable up or down in the spaced slots 60*a* of a guide 61 fixed to the support 15. Inside the guide 61 a slide 62 is mounted which has shaft 59 passing through it with no play and which has a vertical tapped hole into which a height adjustable screw 63 is inserted, this screw being held axially at the top of the guide 61 between a shoulder made on it and a knob 64 controlling the height adjustment. The presser wheel support shaft 59 may, after adjustment, be locked by clamping against the guide 61 firstly its stepped part 65 and secondly a washer gripped by means of a nut and locknut assembly 66 that can be screwed up on the shaft end.

The guides 61 are mounted on the support 15 with a facility for movement parallel to the grinding wheel plane by means of screws 67 inserted in slots 68 (FIG. 5) in the fixing bases of these guides.

As shown in FIG. 5, the magnetic half-pots to be machined, labelled P, are moved along the work table in the direction of travel along the centerline of the two grinding stations by drive means comprising an endless chain 69 extending parallel to the reference plane, i.e., the plane of the table 16, and along it, and the links of which engage with a drive sprocket 70 and an idle sprocket 71 which are mounted on a support plate 72 running along the edge of the table and fixed by screws to two brackets 73 (FIGS. 5 and 7) themseleves fixed laterally by screws to the table support 15.

Figure 9:
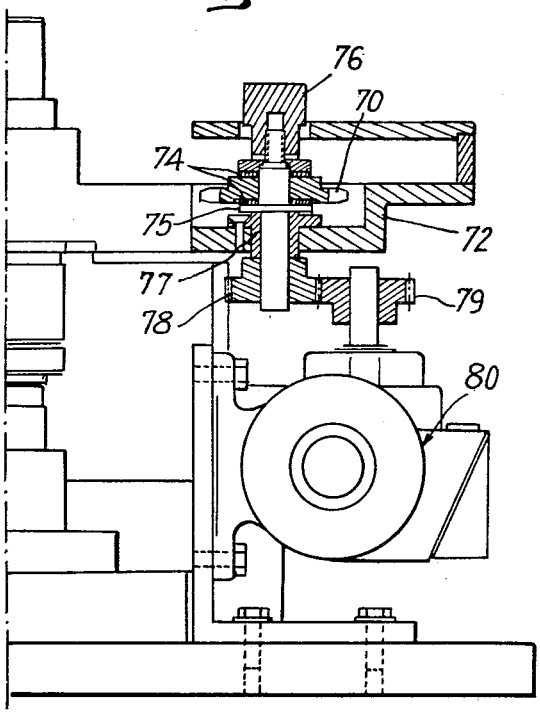
FIG. 9 is a section view along IX—IX of FIG. 5.

As can be seen in FIG. 9, the drive sprocket 70 is held between two friction washers 74 on the top section of a shouldered shaft 75 provided with a clamping nut 76 and having its lower section, rotating inside a support plate 72 fixing sleeve 77, carrying a drive pinion 78 engaging with the output gearwheel 79 of an electric geared motor 80.

The idle sprocket 71 has its shaft 81 mounted in a sleeve which can slide inside a slot 82 in the support plate 72 so as to allow adjustment of chain tension by means of an eccentric cam 83 working in conjunction with the sleeve 82 and locked by tightening up a nut against the support plate 72.

In this example, one in two of the chain link pins, e.g. those labelled 84, is extended above the link plane and a feed element 85 is mounted on each pair of adjacent pins 84, with this feed element comprising a lamellar section designed to move freely between the grinding wheels 21, 24 (FIG. 6) and the corresponding pressure wheels 55, and having openings 86 (FIG. 5) shaped to take and convey, properly oriented, the magnetic half-pots P being machined. This lamellar section is contiguous to a sort of mounting bar 87 which has a hole engaging with one of the pins 84 and a slot 88 engaging with the next pin 84 so as to take up any variation in the distance between centers when the chain passes over sprockets 70 and 71. These feed elements are in practice specific to each class of half-pot being processed, depending on their geometrical shape or their dimensions, and it can be imagined that they are easy to remove and replace at each change in the class of half-pots being machined.

At the grinding station position the endless chain 69 is guided positively along its path by means of two opposite lateral guides 89*a*, 89*b* (FIG. 7) working in conjunction with the link pins and fixed to support 15.

The feed to the openings 86 in the elements 85 providing machine feed of the magnetic half-pots P is provided by means of a chute G (FIGS. 5 and 6) providing for gravity descent of the parts P, stacked vertically above a section where the openings 86 travel in a straight line upstream of the roughing wheel station 21.

This chute is here made of two sections 90 shaped according to the outline of the half-pot and screwed opposite each other onto a support arm 91 mounted as a jib arm on a support rod 92 which is mounted to be adjustable in height on a base 93 for fixing on one edge of the support 15 and to be clampable by means of a screw type clamp 94.

The parts are delivered one by one to the feed elements 85 by adjusting the height of the chute G compared with the table 16, i.e. the height of the base of the sections 91 compared with the table, and to a value which is greater than the thickness of one half-pot but less than the thickness of two stacked half-pots, so that the openings 86 in the feed elements 85 are automatically fed part by part.

The feed to chute G of suitably oriented parts can be ensured in any suitable way outside the invention.

The machine works with the directions of rotation of the drive chain and of the grinding wheels indicated in the drawing by arrows.

The half-pots P, selected one by one at the bottom of the chute G, are driven in line by the feed elements 85 onto the table 16 and thus made, in the first stage, to pass between the roughing wheel 21 and the corresponding pressure wheel (55) which is set to be crushed when rotating in contact with the bottom of the half-pot P and which thus provides an adjustable and well distributed preset pressure on the half-pot while it is being machined. The same occurs for the finishing pass between the finishing wheel 24 and the corresponding pressure wheel 55.

In order to reduce the rubbing of the side edges of the half-pots on the table 16, platens 17*a*, 17*b*, 17*c* are here covered with aligned aluminium plates 95.

In addition, the table support 15, and thus the table, is subjected to a prestress at a stress exceeding the force supporting the half-pots P while they are being machined; this prestressing is here achieved by means of a screw system the screw 96 of which passes freely through the table and is screwed into an upright 97 attached to the base plate 12, whilst it is provided with a head 98 pressing on the table and has a drive square 99 at its top end.

It has been observed that such a solution enables a series of air gaps to be obtained to within plus or minus half a micron, whilst providing for rapid adjustment of the pressure wheels 55 carried out on a few test pieces and remaining very stable in operation; this accuracy is achieved without having to use spindles with fluid bearings but only precision spindles with conventional bearings.

It is also possible, notably, to provide for the machining of only one of the two half-pots making up a pot core, and the accuracy obtained eliminates any inspection and match measurement which generally used to turn out to be necessary.

Of course many variants can be imagined without leaving the field of the invention notwithstanding.

What is claimed is:

1. A machine for finishing magnetic half-pots which have, on the open side, side edges for assembling half-pots together and a center part designed to be machined to create a preset air gap for the pot core assembly, comprising:

a reference plane supporting the side edges of the half-pots, at least one grinding wheel projecting through said reference plane in between said side edges, feed means for feeding said half-pots along said reference plane to said grinding wheel, and pressure means for pressing the side edges of said half-pots onto the reference plane while said center parts is engaged by each said grinding wheel, said pressure means comprising a flexible elastomeric support wheel opposite each said grinding wheel engaging directly each half-pot to form a yieldable back support for grinding, providing the support force by self-deformation while retaining said side edges of said half-pots in contact with said reference plane and thereby providing precision as to the amounts removed from said center part by grinding, said feed means comprising feed elements with openings matched to the shape of the half-pots and lamellar in form, and means for moving said elements freely between said support wheel and said grinding wheel, said means for moving said feed elements comprising a single endless drive chain extending parallel to the direction of travel and in a plane parallel to the reference plane and having extended pins comprising the sole elements on which said feed elements are removably mounted, so as to enable quick replacement of each said feed element, said chain having successive links articulated to each other about axes perpendicular to said reference plane said lamellar feed elements moving along said reference plane, laterally with respect to their respective links and each feed element having a slot and an opening receiving respectively two successive said extended pins.

2. The machine for finishing magnetic half-pots according to claim 1, wherein said reference plane comprises a table, and prestressing means for subjecting said table to a stress exceeding the support force exerted on the half-pots by said support wheel.

3. The machine for finishing magnetic half-pots according to claim 1, wherein said feed means include a gravity chute located vertically above the apertures in said feed elements and at such a height as to provide one-by-one feed selection of the half-pots.

4. The machine for finishing magnetic half-pots according to claim 1, having means for guiding said endless chain positively past the grinding wheel.

5. The machine according to claim 1 having two grinding wheels and two support wheels along a single reference plane with a single endless chain providing said feed elements.

6. The machine according to claim 1 wherein each said half-pot aperture that is matched to the shape of the half-pots is laterally open on a side opposite to said slot and said opening, said feed means comprising a chute from which the half-pots slide along said reference plane transversely relative to the chain.

* * * * *